US010350127B2

(12) United States Patent
Kelly

(10) Patent No.: US 10,350,127 B2
(45) Date of Patent: Jul. 16, 2019

(54) UNILATERAL LEG PRESS MACHINE

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 161 days.

(21) Appl. No.: 15/638,852

(22) Filed: Jun. 30, 2017

(65) Prior Publication Data

US 2018/0000680 A1 Jan. 4, 2018

Related U.S. Application Data

(60) Provisional application No. 62/358,112, filed on Jul. 4, 2016.

(51) Int. Cl.

| | |
|---|---|
| ***A63B 22/00*** | (2006.01) |
| ***A63B 23/04*** | (2006.01) |
| ***A63B 21/062*** | (2006.01) |
| ***A63B 23/035*** | (2006.01) |
| ***A61H 1/02*** | (2006.01) |
| *A63B 71/00* | (2006.01) |

(52) U.S. Cl.

CPC ..... *A61H 1/0259* (2013.01); *A63B 21/0624* (2015.10); *A63B 22/0087* (2013.01); *A63B 23/03525* (2013.01); *A63B 23/03541* (2013.01); *A63B 23/04* (2013.01); *A63B 23/0405* (2013.01); *A63B 23/03508* (2013.01); *A63B 2071/0063* (2013.01); *A63B 2208/0228* (2013.01); *A63B 2225/09* (2013.01)

(58) Field of Classification Search

CPC ..... A63B 21/4011; A63B 21/06; A63B 23/04; A63B 22/20–205; A61H 1/0259

USPC ..... 482/97

See application file for complete search history.

(56) References Cited

U.S. PATENT DOCUMENTS

| | | | | |
|---|---|---|---|---|
| 5,260,870 | A * | 11/1993 | Tsuchiya | A61B 5/224 482/1 |
| 5,762,590 | A * | 6/1998 | St. Fleur | A63B 23/085 482/104 |
| 5,827,154 | A * | 10/1998 | Gill | A63B 21/153 482/9 |
| 6,220,993 | B1 * | 4/2001 | Sencil | A63B 21/0615 482/137 |
| 6,554,751 | B1 * | 4/2003 | Dannelly | A63B 21/068 482/101 |
| 7,115,080 | B2 * | 10/2006 | Cockrill, Jr. | A63B 23/0405 482/138 |
| 7,662,075 | B2 * | 2/2010 | Isom | A63B 23/03525 482/100 |

(Continued)

*Primary Examiner* — Nyca T Nguyen

(74) *Attorney, Agent, or Firm* — Nasser Ashgriz; UIPatent Inc.

(57) ABSTRACT

A unilateral leg press exercise machine is provided. This machine includes a base frame, which is engaged with the floor. The base frame includes bottom side supports, bottom front and back supports to provide stability to the machine. The base frame also includes two sliding carriages which hold resistance plate holders and move in a straight line at an angle of approximately 20 degrees to the floor. 2 resistance plate holders are attached to each moving carriage for a total of 4 and provide the desired weight resistance during the exercise. An adjustable back pad is provided to vary the angles to approximately 15 degrees from the horizontal floor. A set of adjustable shoulder pads on the seat hold the user in place as the back pad is lowered to angles that are closer to the horizontal position.

12 Claims, 7 Drawing Sheets

(56) References Cited

U.S. PATENT DOCUMENTS

| | | | | |
|---|---|---|---|---|
| 2004/0023760 | A1* | 2/2004 | Cockrill, Jr. ..... | A63B 23/0405<br>482/93 |
| 2004/0176223 | A1* | 9/2004 | Morris ..... | A63B 23/0405<br>482/93 |
| 2014/0100088 | A1* | 4/2014 | Ho ..... | A63B 23/0227<br>482/131 |
| 2014/0371036 | A1* | 12/2014 | Ellis ..... | A63B 23/0227<br>482/66 |
| 2015/0367173 | A1* | 12/2015 | Ellis ..... | A63B 21/4047<br>482/127 |
| 2018/0111019 | A1* | 4/2018 | Ellis ..... | A63B 21/068 |

* cited by examiner

UNILATERAL LEG PRESS MACHINE

RELATED APPLICATION

The present application claims priority to the U.S. Provisional Patent Application No. 62/358,112, filed on Jul. 4, 2016.

FIELD OF THE INVENTION

The present invention relates in general to exercise machines and in particular to a unilateral leg press machine.

BACKGROUND OF THE INVENTION

Many athletes and non-athletes utilize weight lifting or weight training exercises to build strength and muscles. Traditionally, these exercises are performed by using free weights, such as barbells, weighted plates, dumbbells, etc. There are also a number of exercise machines that are designed to maximize the effect of training on desired muscle groups in a variety of different exercise routines.

One exercise movement that is considered to be particularly important is referred to as a leg press. A leg press involves the straightening or extension of the legs from a bent or flexed position against weighted resistance. The exercise is performed with the user either seated in an inclined position or pushing at an approximately perpendicular angle against the weight resistance, or lying on the back and pushing upward against the weight resistance.

Typical leg press machines are commonly referred to as "45 degree leg press machines" because the angle of the moving resistance relative to the horizontal surface that the machine sits on is 45 degrees. With common leg press machines, the angle of the torso relative to the legs in full extension is approximately 90 degrees.

The leg press is particularly effective in building the hamstrings muscles of the legs. It is also particularly effective in building the quadriceps muscles of the legs. It can also strengthen the hip muscles, lower leg muscles and generally all of the muscles of the legs. Perhaps more importantly, exercising the muscles associated with the leg press motion develops the general "thrusting" capability and strength of the legs.

While the leg press exercise develops some of the strongest and largest muscles of the human body, the user may need to overcome force vectors and movement patterns created by these machines, which are not congruent with normal human movement. The heavier weights, typically used on these machines, which are moved by the powerful leg muscles, can cause the lower back to go into an unhealthy flexion, or outward rounding. When this occurs, the lower spine is put at risk of serious injury.

Because the main concentric portion of this exercise begins with the legs in a retracted position, initial stress on the ankles, hips and particularly the knees and the lower back can be substantial. It is important for the user to retain a correct and safe lower back posture when using such a machine, so that the lower back remains in a healthy extension during the exercise and it is not forced into a rounded or flexed position, especially when using a heavy resistance.

While compressive forces on joints associated with the leg press exercise is simply unavoidable, this joint stress can be and should be made positive. This is achieved by designing and creating special angles on the seat, backrest and foot press plates, particularly at the initial stages of the moving leg press exercise, which are healthier and more natural and congruent with normal human biomechanical movements. Further, these more preferable and optimal angles will allow for greater transfer of strength gains and increased human performance from using such a leg press machine into sports, work and life. This will be a safer and more effective creation and transfer of strength and performance benefits, than a typical leg press will allow.

Leg press machines are designed to provide a safer but similar squatting exercise by eliminating the requirements of balance and stability to complete the free weight movements and removing the active inclusion of the back muscles to push the resistance by flexion and extension forward of the hips. These machines provide a starting position whereby the legs are semi-extended. The resistance is then pushed out such that the legs are completely extended. The legs then bend to yield the resistance as the user's legs are compressed into the squatting position with the knees bent. The user will then push the resistance out with their legs such that they finish with their knees fully extended and legs straightened at the finish.

While the movement is similar to a free weight squat or dead lift exercise, the leg press machines do not provide the same body alignment, joint angles, force direction or posture as those standing free weight movements. The reason for this is that they fix the user's body into a locked pattern, whereby the angle of the backrest and the footplate will not allow a movement pattern which is similar to free weight movements such as squats or dead-lifts.

During a free weight squat or dead lift movement the body is constantly making minor adjustments to keep the feet, knees and back in proper alignment, such that the resistance is over the user's center of gravity while they complete the movement. This adjustment does not take place just at the beginning or at the end of the exercise; it happens continuously throughout the entire movement. The most optimal movement pattern of the resistance during these free weight exercises is a vertical or a straight line. This is the most efficient and desired movement pattern, whereby the resistance moves in a straight line directly over one's center of mass and center of gravity.

Fitness machines, such as leg press machines, by their very nature do not require the neutralizing, stabilizing, reinforcing and balancing muscles that are required in valuable free weight exercises such as squats or dead-lifts. In addition, they do not require the physical abilities inherent in free weight exercises, such as squats or dead lifts, where the resistance must be balanced and lifted by the user at the same time in order to successfully complete such exercises. In addition, compared to movements such as a free weight squat or dead lift, with the leg press the force vectors are reversed. Yet, the same joint angles and lines of force that exist in the lowest part of the movement and during the concentric drive upward can be approximated in a leg press to better approximate these more natural movement. In addition, the same close to vertical movement pattern required in a free weight squat or dead lift can also be approximated.

Typical leg press machines do not provide the correct approximation of joint angles, lines of force or straight-line movement patterns inherent in more natural free weight movements, such as squats or dead lifts. It is desired to have a leg press machine that can provide and replicate the natural human movement in relation to the joint angles, lines of force and direction of movement and forms of resistance. The present machine is invented to provide such a function.

SUMMARY OF THE INVENTION

The present unilateral leg press machine includes a base frame, which is engaged with the floor. The base frame includes bottom side supports, bottom front and back supports to provide stability to the machine.

The frame includes sliding carriages to which resistance plate holders and individual footplates are attached. The carriages slide in a straight line at an angle of approximately 20 degrees in relation to the floor, and on metal dowels that are attached to the base frame. Each of the carriages is connected to footplates and includes plate holders to receive removable weight plates to provide the desired weight resistance during the exercise.

Two resistance weight plate holders per side connect to each of the sliding carriages, for a total of four. The carriages move independently, such that the user may use the machine in a unilateral manner, whereby the force created to push the footplates is independent for each leg. This allows the user to develop the muscles of each leg independently and to be able to readily compare the relative strengths of both legs and expose a strength deficit of one leg relative to the other. This also allows an injured leg to be trained in rehabilitation after an injury. The machine may also be used in a bilateral manner, as a pin is provided that may connect the two footplates. The pin may be used to connect the moving footplates and resistance or removed so that the user can move them independently. As such, this machine may be used in a bilateral or unilateral way.

It is an object of the present invention to provide an improved leg press machine that maximizes muscular benefit achieved during performance of a leg press exercise, but with minimized negative and optimized positive and more natural stress upon joints associated with the muscle group that performs the leg press movement.

It is another object of the present invention to provide similar and replicate joint angles and movement patterns of more natural human movements and free weight exercises such as various forms of the squat and dead-lift at the lowest positions of those exercise ranges and during the lower portion of the concentric drive upward in those exercises.

It is another object of the present invention to provide a secure, safe position of the user during the leg press exercise by designing the seat and back support pads in such a way that they enable and support an ergonomically safe, extended lower back position. The design of the seat and back pads reinforce the natural convex and concave curvatures of the lower spine. The design supporting a lower back extension is vital for a much safer machine and a healthy, correct back position when the user is completing the leg press exercise.

Another object of the present invention is to provide adjustable shoulder pads which allow the effective use of the leg press machine, given the force vectors that occur with the more open angles of this machine, which replicate the actual free weight movements of various forms of the squat and dead lift exercises. In addition, the inclusion of the shoulder pads creates tension and load on the user's torso, which is of added benefit and elongates the kinetic chain (connected portions/parts of the body involved in the exercise) for this leg press machine. This tension is more directly inline and through the center of the user's torso and center of gravity, as it would be when they are completing a free weight squat or dead-lift exercise.

Another object of the present invention is to provide a leg press machine equipped with resistance carriage stoppers for a safe and secure exercise and to enable specific training by adjusting the range of the movement to various ranges and which will enable the removal of the myotatic stretch reflex for different muscular and neuro-muscular adaptations, results and benefits.

It is another object of the present invention to provide large foot pads for a multitude of different possible adaptations and the emphasis of different muscular groups by varying stance width, height and/or a combination of both.

It is another object of the present invention that the unilateral foot pads are changeable to bi-lateral, so that the machine can be used in both a unilateral and bilateral position via a removable pin.

It is another object of the present invention that the angle of the sliding resistance to the floor is set at approximately 20 degrees to the floor such that the postural angles of the user may replicate those of more natural free weight movements such as various forms of squats and dead lifts.

It is another object of the present invention that the angle of the adjustable back pad is adjustable to as low as approximately 15 degrees to the floor such that the postural angles of the user may replicate those of more natural free weight movements such as various squats and dead lifts.

It is another object of the present invention to provide band hooks connected between resistance carriages and the frame of the machine to allow for the use of exponential resistance, and to provide three forms of resistances: Static weight, exponential band resistance, and the combination of both static weight and band resistance.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
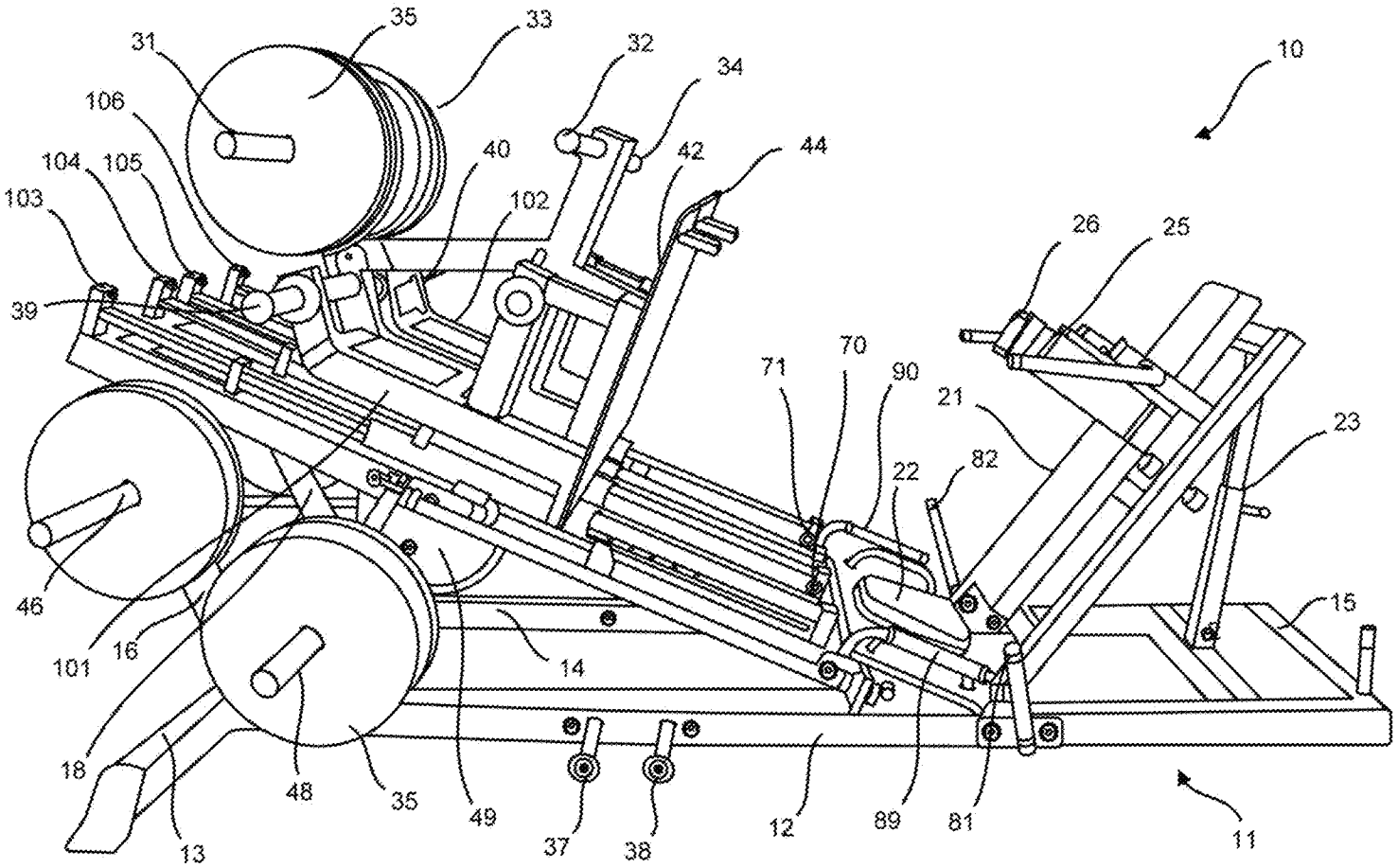
FIG. 1 shows a perspective view of a unilateral leg press exercise machine in accordance with a preferred embodiment of the invention.
Figure 2:
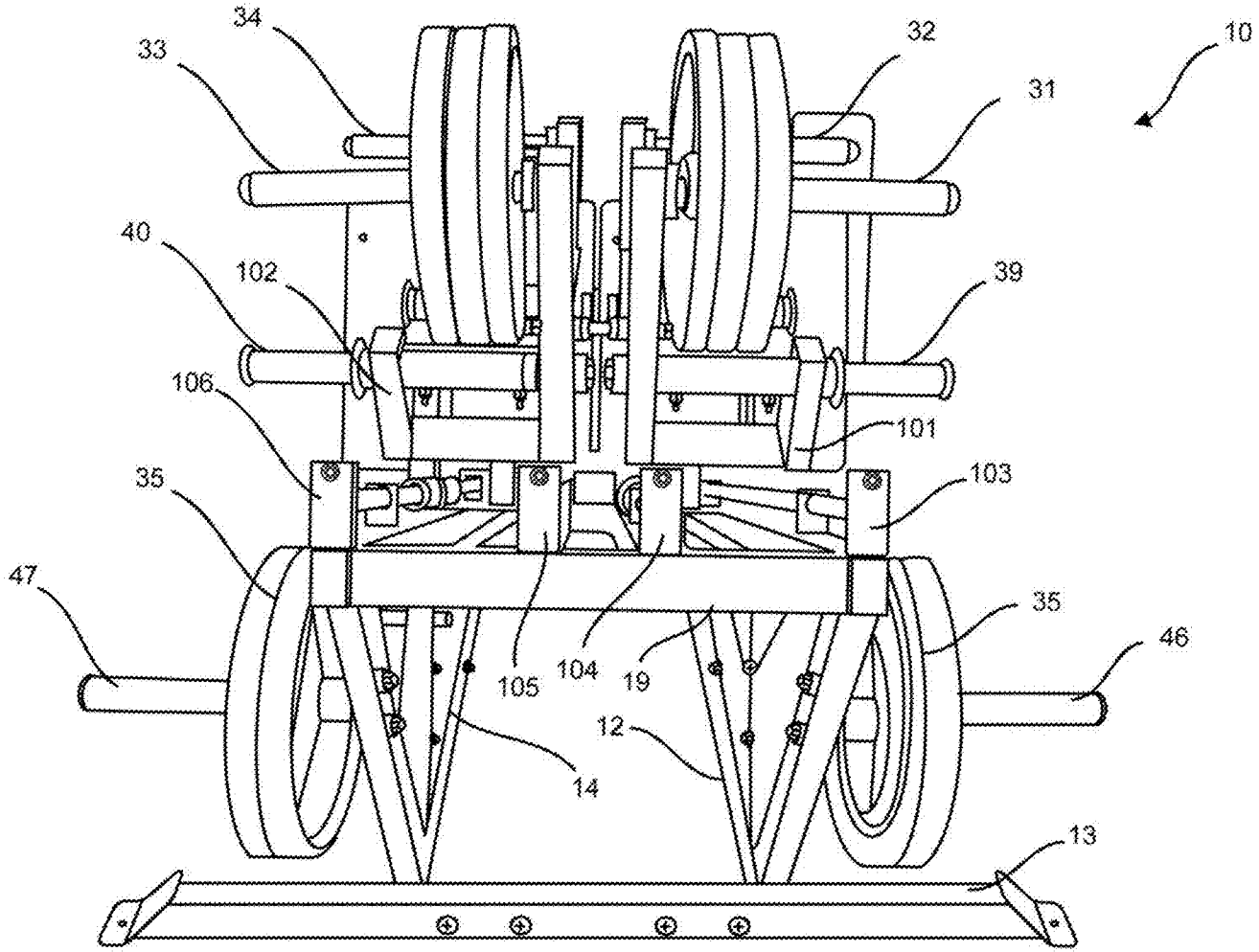
FIG. 2 is a perspective front view of the present invention showing the resistance system of the leg press machine.
Figure 3:
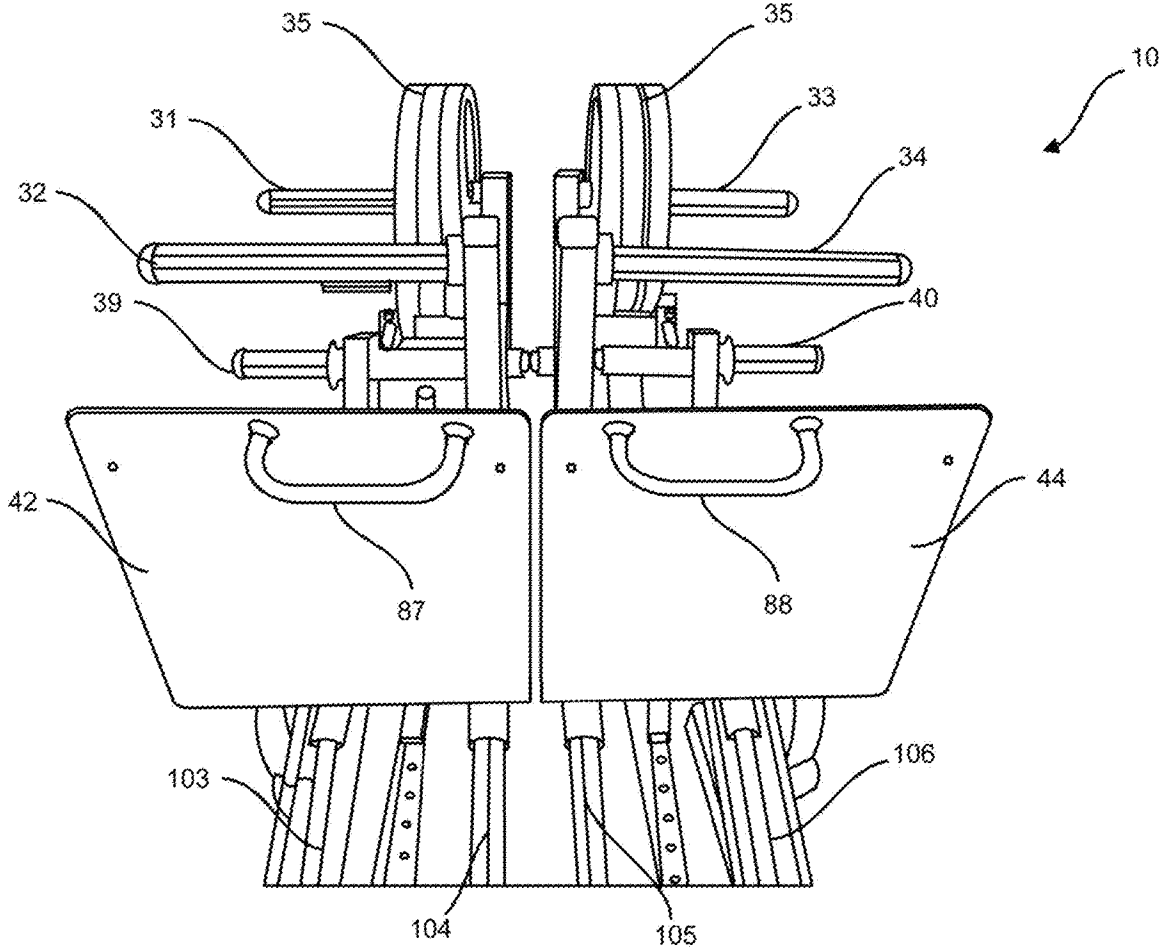
FIG. 3 is a perspective view of the footplates according to the present invention.

FIGS. 1, 2 and 3 show a unilateral leg press machine 10 in accordance with the present invention. The machine 10 includes a base frame 11, which is engaged with the floor and is large enough to provide stability to the machine. The base frame 11 includes bottom side supports 12, 14, and bottom front and back supports 13, 15. The base frame 11 also includes horizontally extending support legs 16, 18. The frame 11 includes 2 sliding carriages 101, 102 on each side to which resistance plate holders 31, 33, 32, 34 and individual foot plates 42, 44 are attached. The carriages 101, 102 slide in a straight line at an angle approximately 20 degrees in relation to the floor on metal dowels 103, 104, 105 and 106 that are attached to the base frame 11. Each of the carriages 101 and 102 are connected to footplates 42, 44 and include plate holders to receive removable weight plates to provide the desired weight resistance 31, 33 and 32, 34 during the exercise.

Each of the carriages 101, 102 slide on a pair of supporting metal dowels 103, 104, 105, 106. Carriage 101 slides on metal dowels 103 and 104 and carriage 102 slides on metal dowels 105 and 106. A horizontal supporting legs 19 is provided parallel to the front support 13 on the frame 11 for stability. Two weight plate holders per side 31, 32, 33, 34 connect to each of the moving carriages 101, 102. The plate holders 31, 32 are connected to the carriage 101 and plate holders 33, 34 are connected to the carriage 102. The carriages 101, 102 move independently such that the user may use the machine in a unilateral manner whereby the force created to push the footplates is independent for each leg.

The present invention further comprises of two wide foot plates 42, 44 which allow the user's feet (or foot if used individually) to press against the resistance from a variety of positions. The footplates 42, 44 are mounted onto two moving carriages 101, 102 that hold the resistance weight 35 and move in a straight line when in use. The moving carriages 101, 102 hold the resistance 35 and slide freely in a straight line at approximately 20 degrees in relation to the horizontal floor surface through metal dowels 103, 104, 105, 106 that are attached to the frame 11 of the machine 10. The wide footplates 42, 44 allow the user to change the position of the foot on the foot plates up, down or to either side, whereby work on various different muscles of the legs may be emphasized.

Two separate footplates 42, 44 are connected to two separate metal carriages 101, 102 which move or slide on metal dowels 103, 104, 105, 106 to develop independent unilateral control of the muscles of each leg and to be able to readily compare relative strengths of both legs. This will also allow a user to do more work with a weaker leg to then create strength that is more equitable and/or sized to the stronger leg. The footplates 42, 44 are mounted on leg press carriages 101, 102 which glide at an approximately 20-degree angle from the floor and which are attached to the base frame 11. The other advantage of the wide footplates is to allow the user to change the position of the foot to emphasize and train different muscle groups and to also accurately replicate forms of free weight squats involving narrow or wider squat stances.

Figure 4:
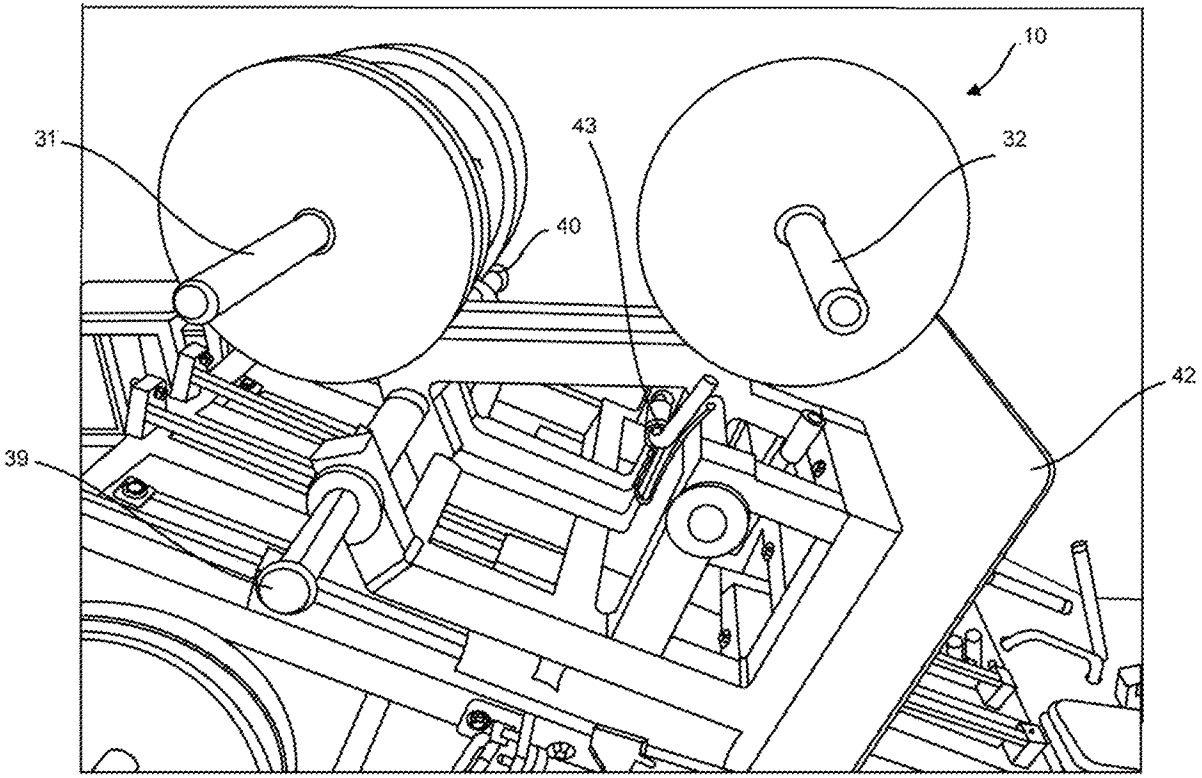
FIG. 4 is a perspective view of the resistance plate holders and the upper band hooks according to the present invention.

According to FIG. 4, the machine 10 has a locking mechanism 43 to switch the unilateral footplates to bilateral footplates. The unilateral aspect of the leg press will be changeable to bilateral, by connecting the two footplates 42, 44 by a pin or a removable metal rod or other suitable locking means. The leg press machine can also be used in a bilateral manner, as the pin 43 may connect the moving two foot plates and resistance or removed such that they must be moved independently by the user.

The footplates can be used with both legs or a single leg. A removable metal rod to allow for one large singular resistance weight plate and therefore a connected bilateral movement whereby the force of both legs is applied collectively and not individually.

Two weight plate resistance holders per side 31, 32, 33, 34 of the machine for a total of 4 (four) are engaged to the moving resistance carriages 101, 102 which attach to the foot plates 42, 44 on the machine to receive the weight plates as resistance when the machine is being used.

Two weight plate storage holders per side of the machine for a total of 4 (four) 46, 47, 48, 49 are engaged to frame 11 of the machine at the rear side of the foot plates 42, 44 to receive the weight plates 35 for storage when they are not in use as actual resistance on the machine.

The present invention 10 is further equipped with band hooks 37, 38, 39, 40 on both sides. The lower band hooks 37, 38 are attached to the bottom side support 12 of the lower frame of the machine on both side and the upper band hooks 39, 40 are attached to each of the moving resistance carriages 101, 102, on both sides of the machine. The band hooks 37, 38, 39 and 40 allow for the addition of much greater resistance to the machine. Further, the use of bands allows for exponential resistance as the bands stretch and become more difficult to push further into the movement range as the foot plates are extended. Therefore, this machine can be used with three types of resistances: Static weight plates, elastic bands exponential resistance, or combination of both plates and bands.

Again referring to FIG. 1 a seat pad 22 is mounted at the distal end of the base frame 11. The seat 22 has an adjustable back pad 21 to enable the user to adjust the back rest of the seat at various angles, which suits to his/her exercise and may replicate various versions of the free weight squat or dead-lift.

The adjustable back pad 21 is comprised of a hinged telescopic leg 23 to adjust the angle of the back pad according to the user's comfort and desired back angle. This adjustable back pad 21 is most effectively used to replicate the angle of the user such that it is similar to a free weight squat or dead-lift during the user's lowest position of those exercises or during the drive up against the resistance while completing those free weight exercises. The back pad 21 adjusts to as low as approximately 15 degrees from the horizontal floor.

Figure 6:
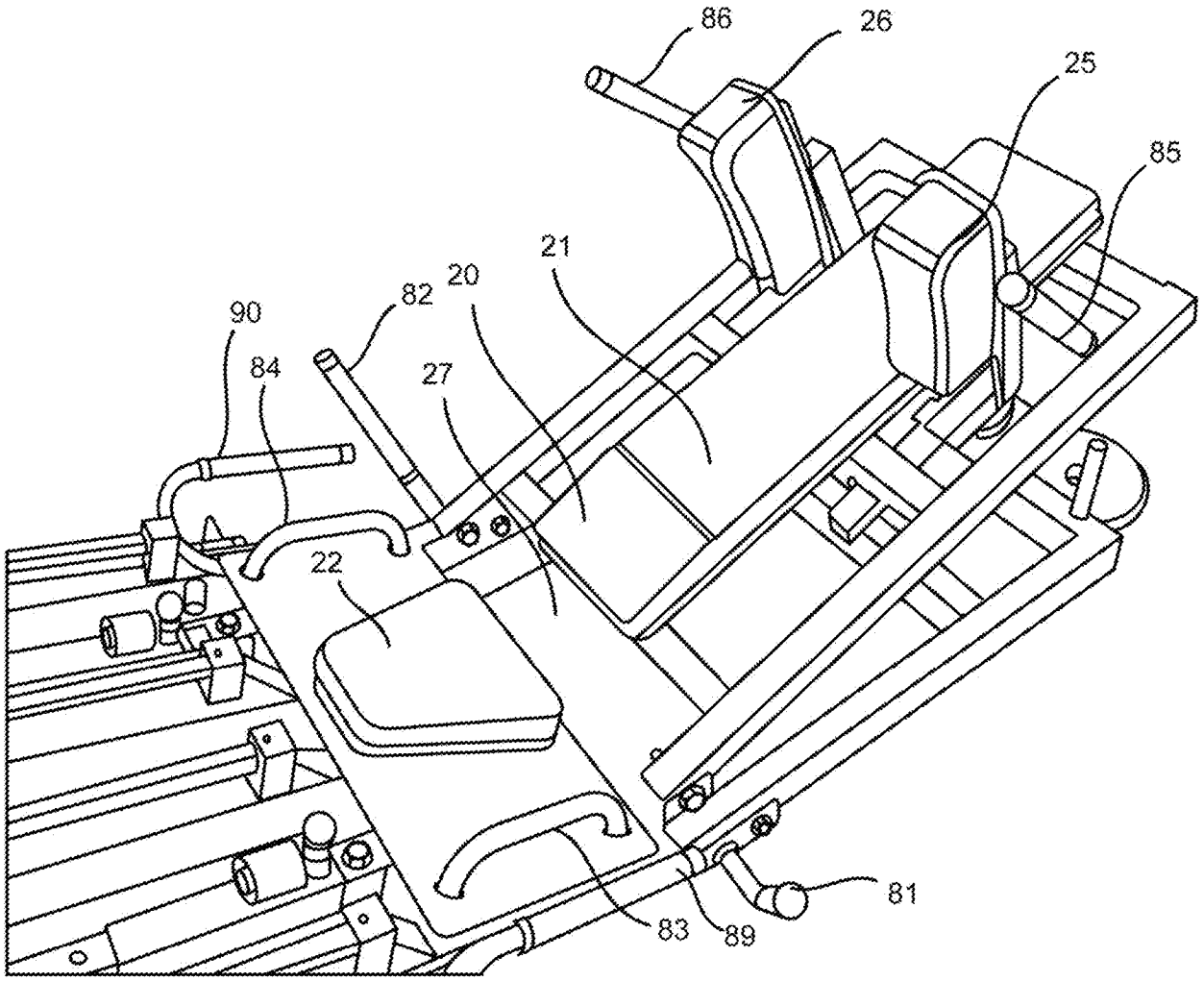
FIG. 6 is a perspective view of the leg press machine showing the seat, back pad, shoulder pad and handles, according to the present invention.

As shown in FIG. 6, the back pad adjusts to as low as approximately 15 degrees from the horizontal floor. Since the leg press machine of the present invention provides more open angle for the back position, there is more of a natural and correct alignment and positioning of the spine and less tendency for the lower back to go into a rounded, flexed position. The back pad is designed to adjust to create larger or smaller angles, very close to the horizontal position, which allow the possibility to have the present adjustable back pad, create a more realistic replicate angle of the basic compound movements, inherent in different forms and versions of the free weight squats or dead-lifts. The adjustable back pad is most effectively used to replicate the angle of the user such that it is similar to a free weight squat or dead-lift during the user's lowest position of those exercises or during the drive up against the resistance while completing those free weight exercises.

According to FIG. 6, the back pad is further equipped with shoulder pads 25, 26, which hold the user in place as the back pad 21 is lowered to angles that are closer to a horizontal position. The shoulder pads 25, 26 adjust to the inch to lock the user into position such that the resistance will not push them out of the seat pad. Adjustable shoulder pads are provided at the top of the back pad to hold the user's shoulders down when pushing out heavy weight with the legs. The back pad of the seat adjusts backward and down toward the floor causing the back angle to be closer to a horizontal position at approximately 15 degrees from the floor. The force vectors are then directed backwardly and the user feels as though the weight is pushing him/her back and right out the seat. Shoulder pads, which are adjustable to the inch, correct this problem and counter the typical force vectors of a free weight squat or dead-lift movement by locking the user safely and effectively into the seat of the machine.

A space 27 is provided between the seat pad 22 and the back pad 21. This space 27 increases in size as the back pad is adjusted lower toward the floor. This space 27 is vital to allow the low, sacral curve of the user's back, which is naturally concave or outward curving, to fit correctly and comfortably between the seat pad 22 and back pad 21 to accommodate a healthy, natural extension of the lower back.

The lower portion of the back pad cushion 20 protrudes outward to further reinforce the natural convex or inward curving shape of the lumbar area of a user's lower back. The combination of the space 27 between the pads and the slightly protruding lower portion of the adjustable back pad 20 creates a safe, secure, comfortable and ergonomically friendly lower back extension while using the leg press machine 10. This creates less likelihood of a rounding or flexing of the lower back, and allows and helps to reinforce the natural shape of the user's sacral and lumber lower back areas. Whereas the pad design of other leg press machines actually helps to reverse these safe, natural curvatures of the user's lower back, the seat and back pad design of the present machine actually helps to protect the user and keep them safe from injury in this regard.

Again referring to FIG. 6 a plurality of hand grips are provided on the machine, a pair of handgrips 81, 82 be mounted on an angle onto the frame on each side of the seat pad 22. A second pair of handles 83, 84 are mounted, one on each side directly beside of the seat 22. A third pair of handles 85, 86 are mounted directly onto the adjustable shoulder pads 25, 26. These handles are all for the user to grip while using the machine.

Referring to FIG. 3 a fourth, set of handles 87, 88 is located on the inner side of each of the footplates 42, 43 facing the user to safely climb into and out of the machine.

Again referring to FIG. 1 and FIG. 6 a pair of handles 89, 90 are provided one on each side of the seat pad for holding up the carriages 101, 102. To use the machine 10, the user initially presses against the footplates 42, 44 with his/her feet, from any of the given resting positions of the resistance carriages. There is a plurality of given resting positions of the resistance carriages to correctly accommodate effective starting positions for users of differing leg lengths. The user can push the two handles 89, 90, one on each of the side of the machine, out to the side, to disengage the handles from holding up the carriages 101, 102 holding the resistance instead completely engage and support the resistance with his/her legs. When finished using the machine, the user will extend his/her legs completely and pull the same handles 89, 90 on each side of the machine back into place, thereby the handle mechanisms are once again completely support the resistance carriages. The handles 89, 90 will provide full and complete support for the user to exit the machine.

Figure 5:
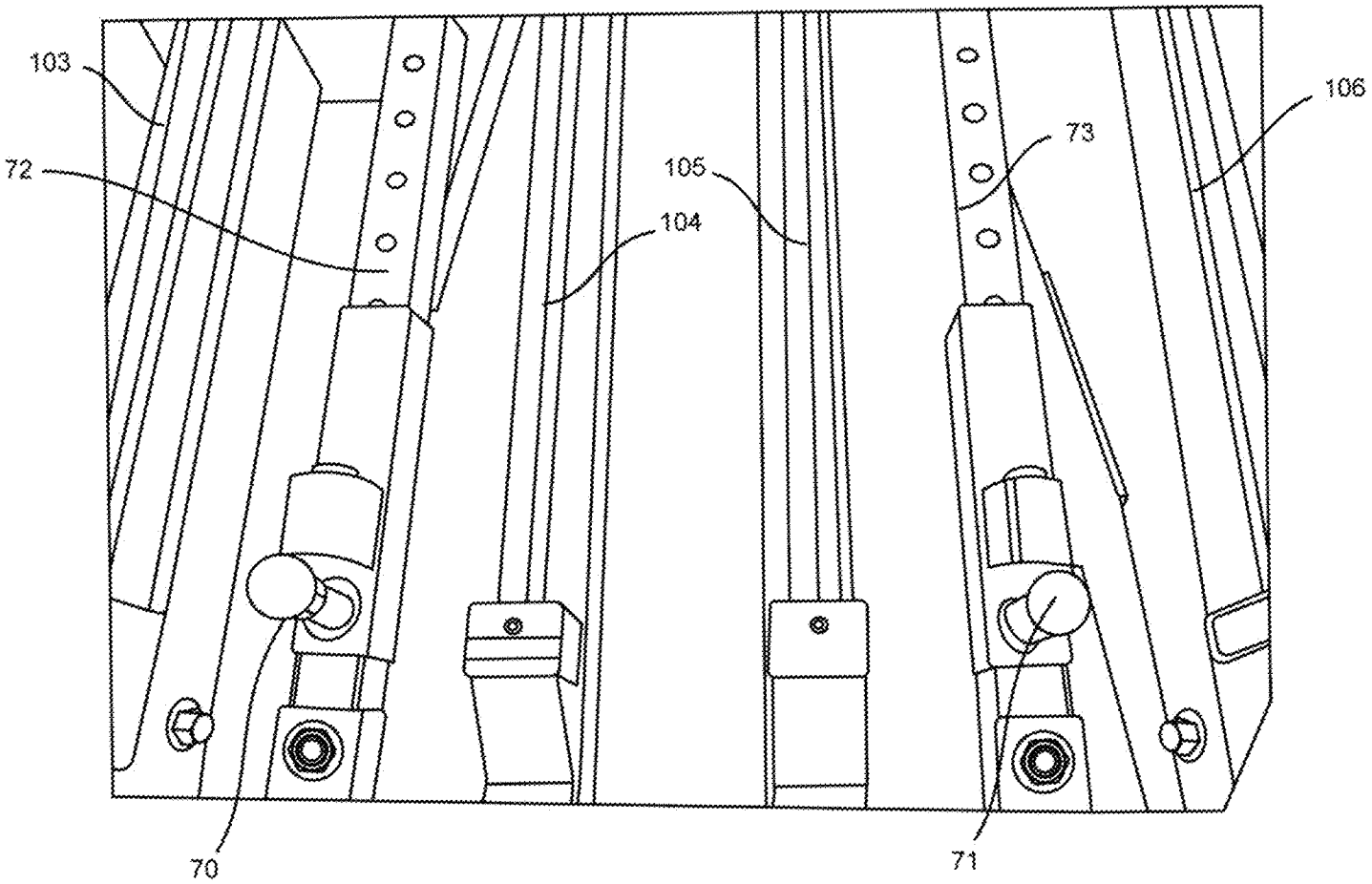
FIG. 5 is a partial view of the present invention showing the leg press stopper system and the metal dowels.

According to FIG. 5 the leg press machine of the present invention 10 is provided with stoppers for the safety of the user of the machine. Adjustable safety stoppers 70, 71 are mounted onto the top of two steel tracks 72, 73 (one for each foot plate) which run between each of the two of the metal dowels 103, 104, 105, 106 on which each of the resistance carriages move. These stoppers allow for the adjustable, restricted and limited range of the resistance carriages and to ensure the safety of the user.

Figure 7A:
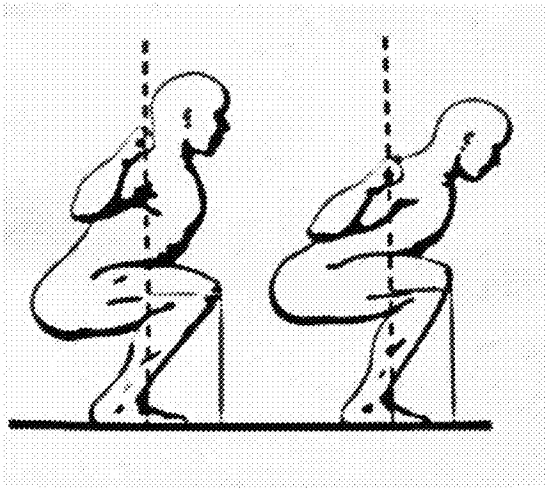
FIG. 7A is a schematic view of the angles of the body performing high bar and low bar squad.
Figure 7B:
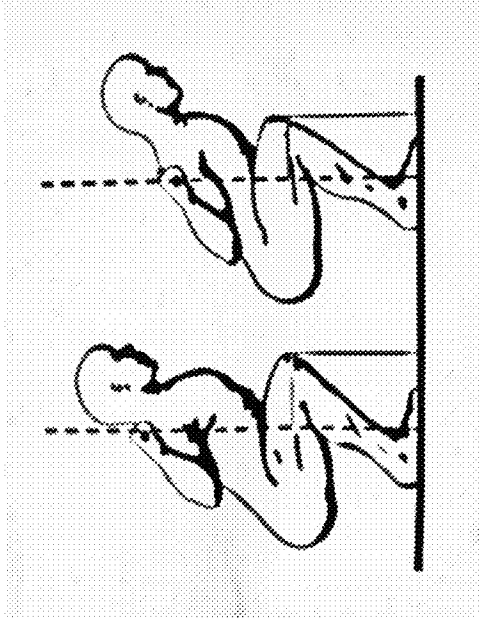
FIG. 7B is a schematic view of the angles of the body, performing leg press exercise.

According to FIG. 7A, 7B, in all free weight movements, the bar must travel in a straight line over the center of the gravity for the most efficient use of force, to allow the most weight to be lifted and for the exercise to be executed optimally and with the most benefit. With this leg press exercise machine, the user draws a straight line through the center gravity of the body and turns it horizontally, so the direction of force of the angles of the body are the same as various forms of the free weight squat and dead-lift.

The straight-line movement patterns, over the center of gravity and center of mass represented by valuable free weight exercises such as various forms of squats are highly represented by this leg press machine. The machine is designed such that those same free weight straight-line patterns and postural positions are essentially replicated, but in this case, in a more horizontal direction. As such, with this machine, the user gets the same angles and straight lines of force as those in squatting and dead-lift exercises. However, in this case, the user literally pushes the resistance away, while mimicking those joint angles as closely as possible. Further, the direction of the force or the force vector is reversed, as though the user is pushing the floor away from them while squatting. Thus creating an entirely new and different adaptation of a typical 45 degree leg press, free weight squats, or dead-lifts.

The leg press machine of the present invention is comprised of two wide footplates which allow the user's feet (or foot if used individually) to press against the resistance from a variety of positions. The footplates are mounted onto two sliding carriages that hold the resistance weight and move in a straight line when in use. The moving carriages hold the resistance slide and move freely in a straight line at approximately 20 degrees in relation to the horizontal floor surface through metal dowels, which are attached to the frame of the machine. The wide footplates allow the user to change the position of the foot on the footplates up, down or to either side, whereby work on various different muscles of the legs may be emphasized.

The angle at which the resistance attached to the footplates moves on this leg press machine is unique, because one of the main goals of the machine is to create a squat-like or dead-lift-like exercise, whereby instead of the user pushing the resistance on his/her back up from a firm position on a solid floor, the reverse is allowed to happen. That is, the users' upper body is secured and they push against a surface, which replicates the floor being pushed away from the user when doing a typical free weight squat or dead-lift. Thus, a scalable resistance exercise is created that represents the reverse force vector of the squatting or dead-lifting movements. This new and different replication creates stimulation which provides new, far more effective and optimal physical adaptations for the user. This resistance foot plate angle of movement is approximately 20 degrees to the floor. In contrast, typical leg press machines are fixed at a 45 degree angle to the horizontal floor.

Two separate footplates are connected to two separate metal carriages which move or slide on metal dowels to develop independent unilateral control of the muscles of each leg and to be able to readily compare relative strengths of both legs. The footplates can be used with double leg or single leg. A removable metal rod to allow for one large singular resistance weight plate and therefore a connected bilateral movement whereby the force of both legs is applied collectively and not individually connects them.

The leg press machine of the present invention is provided with stoppers for the safety of the user of the machine. Adjustable safety stoppers are mounted onto the top of two steel tracks (one for each foot plate) which run between each of the two of the metal dowels on which each of the resistance carriages move. These stoppers allow for the adjustable, restricted and limited range of the resistance carriages.

To use the machine, the user initially presses against the foot plates with their feet from any of the given resting positions of the resistance carriages. There is a plurality of given resting positions of the resistance carriages to correctly accommodate effective starting positions for users of differing leg lengths. The user will then push the two handles, one on each of the side of the machine out to the side, to disengage the handles from holding up the carriages holding the resistance and instead to completely engage and support the resistance with their legs. When they are finished using the machine, they will extend their legs completely and pull the same handles on each side of the machine back into place whereby the handle mechanisms are once again completely supporting the resistance carriages. The user will then be disengaged from supporting the resistance as the machine handles will provide full and complete support for the resistance and the user may exit the machine.

The leg press works all major muscles in the lower body. However, the variations of the foot position on the large foot plates will determine which muscles are emphasized during the exercise. The major muscles groups involved in the exercise and which may be emphasized include all of the muscles of the legs including the quadriceps, hamstrings, calf or lower leg muscles, hip abducting and adducting muscles, groin muscles, and glute muscles, etc. Further, the muscles of the torso and arms may also be involved and under tension due to the shoulder pads and the hand grips. All muscles of the body may be involved in an isometric contraction manner, depending on the intensity level with which the machine is used.

The user's ankles, knees, and hips and legs are being dynamically trained, while the user's upper body and head are actively stabilized. Additionally, the user may grasp a plurality of different pairs of hand grips for both comfort, individual arm length and general preference.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Including but not limited to creating an angle of the sliding resistance that is less than or greater than 20 degrees and a back pad that lowers to less than 15 degrees both in relation to a horizontal floor.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A unilateral leg press machine comprising:

a. a base frame to sit on a floor;

b. an inclined rack having a set of tracks, said inclined rack being attached to said base frame at a predefined rack-angle relative to said base frame;

c. a pair of sliding carriages, each said carriage slidably attached to a pair of tracks of said set of tracks on said inclined rack, and each said carriage having a front side and a back side;

d. a pair of wide footplates, each footplate attached to said front side of each said sliding carriages, whereby each said wide footplate provides a wide area to change the position of a foot to work on various muscles of a leg;

e. a pair of weight plate holders, each said weight plate attached to the back side of each said sliding carriage;

f. a seat mounted on said base frame, wherein said seat is substantially aligned with said inclined rack and having said rack-angle relative to said base frame;

g. a back-seat having a lower portion and an upper portion, said back-seat is installed on said base frame with an adjustable back-seat-angle with respect to said base frame, and wherein said back-seat being at a predefined distance from said seat, thereby forming a back-space between said seat and said seat-back to accommodate a healthy extension of a lower back of a user and to help to reinforce a natural shape of the user's sacral and lumber lower back areas;

h. a pair of adjustable shoulder pads mounted on the sides of said upper portion of said seat-back, wherein said shoulder pads adjust along a length of said seat-back to prevent said user to be pushed out of said seat while performing the exercise;

i. a plurality of weight resistances to be installed on said pair of weight plate holders, whereby said sliding carriages move independently and the weight on each said sliding carriage is adapted to be change independently, allowing the user to develop strength in each leg muscle individually.

2. The unilateral leg press machine of claim 1, wherein said rack angle is 20 degrees, thereby allowing said pair of sliding carriages to move at an angle of 20 degrees in relation to the base frame, whereby creating a more effective and optimal physical adaptation for a free weight squat.

3. The unilateral leg press machine of claim 1, wherein said back-seat angle is adjustable in a range of 15 to 90 degrees relative to the base frame.

4. The unilateral leg press machine of claim 1, wherein each track of said set of tracks comprising of a metal dowel or a shaft to receive each said slidable carriage.

5. The unilateral leg press machine of claim 1, further has a pair of adjustable safety stoppers, wherein each said safety stopper is mounted on each said track to restrict and limit the range of movement of each said carriage and each said footplate.

6. The unilateral leg press machine of claim 1, wherein said lower portion of said back-seat protrudes outwardly to reinforce the natural convex shape of the lower back of said user.

7. The unilateral leg press machine of claim 1, further comprising a connecting mechanism to connect said pair of carriages to use said machine in a bilateral mode, and to switch said unilateral footplates to bilateral footplates.

8. The unilateral leg press machine of claim 7, wherein said connecting mechanism is a pin.

9. The unilateral leg press machine of claim 1, further comprising a plurality of hand grips installed on both sides of said seat.

10. The unilateral leg press machine of claim 1, further comprising a pair of static-weight plate holders statically attached to said base frame and being vertically aligned with said pair of weight plate holders, to store weight plates.

11. The unilateral leg press machine of claim 1, further comprising a set of elastic band hooks connected between said pair of weight plate holders and said pair of static-weight plate holders to provide exponentially increasing resistance.

12. The unilateral leg press machine of claim 1, wherein said base frame having a set of bottom side supports, bottom front supports, bottom back supports and plurality of vertical supports to provide stability to the machine.

* * * * *